US005306687A

United States Patent [19]

Furuya et al.

[11] Patent Number: 5,306,687

[45] Date of Patent: Apr. 26, 1994

[54] THERMOSENSITIVE RECORDING MATERIAL

[75] Inventors: Hiromi Furuya, Shimizumachi; Keishi Taniguchi, Susono; Kunio Hayakawa, Gotenba; Masafumi Torii, Shizuoka; Shoji Maruyama; Keishi Kubo, both of Yokohama, all of Japan

[73] Assignee: Ricoh Company, Ltd., Tokyo, Japan

[21] Appl. No.: 46,796

[22] Filed: Apr. 16, 1993

[30] Foreign Application Priority Data

Apr. 17, 1992 [JP] Japan ..... 4-124116
Dec. 15, 1992 [JP] Japan ..... 4-354203

[51] Int. Cl.[5] ..... B41M 5/30

[52] U.S. Cl. ..... 503/207; 503/208; 503/209; 503/225

[58] Field of Search ..... 427/150, 151, 152; 503/207, 208, 209, 225

[56] References Cited

U.S. PATENT DOCUMENTS 4,479,138 10/1984 Ikeda et al. ..... 503/207

FOREIGN PATENT DOCUMENTS 57-128592 8/1982 Japan ..... 503/208
58-59894 4/1983 Japan ..... 503/208

*Primary Examiner*—B. Hamilton Hess
*Attorney, Agent, or Firm*—Oblon, Spivak, McClelland, Maier & Neustadt

[57] ABSTRACT

A thermosensitive recording material composed of a support, and a thermosensitive recording layer formed on the support, containing a leuco dye, a color developer capable of inducing color formation in the leuco dye upon application of heat thereto, and a thermofusible material including p'-methylphenyl p-chlorobenzoate serving as a thermosensitivity-improving agent.

5 Claims, No Drawings

THERMOSENSITIVE RECORDING MATERIAL

BACKGROUND OF THE INVENTION

1. Field of the Invention

The present invention relates to a thermosensitive recording material comprising as the main components a leuco dye serving as a coloring agent and a color developer capable of inducing color formation in the leuco dye upon application of heat thereto, and a particular thermosensitivity improving agent.

2. Discussion of Background

There are conventionally proposed various recording materials which utilize the coloring reaction between a colorless or light-colored leuco dye and a color developer capable of inducing color formation in the leuco dye upon application of heat or pressure thereto when brought into contact with the leuco dye.

A thermosensitive recording material, one of the above-mentioned recording materials, is usable as a recording material for an electronic computer, facsimile apparatus, ticket vending apparatus, label printer, and recorder because it has the advantages that complicated processes such as development and image-fixing are not required, recording can be achieved for a short period of time using a relatively simple apparatus, there is no noise development, and the manufacturing cost is low.

In such a thermosensitive recording material, colorless or light-colored leuco dyes having a lactone, lactam, or a spiropyran ring are used as coloring dyes, and organic acids or phenols are conventionally employed as color developers. The thermosensitive recording material using the above-mentioned leuco dye and color developer is widely used for practical use because the produced images have high density, with the whiteness of the background maintained high.

In line with the increase of demands for the thermosensitive recording system, the requirements for high speed recording are increasing. Therefore, not only the development of a high-speed recording apparatus, but also the development of a recording material capable of coping with the above-mentioned high-speed recording apparatus is intensively desired.

To cope with the high-speed recording system, it is proposed to use p-hydroxybenzoate and hydroxynaphthoate as the color developers with high sensitivity, as respectively disclosed in Japanese Laid-Open Patent Applications 56-144193 and 59-22793. However, the recording materials comprising the above color developers have a shortcoming in the preservability of the obtained images therein.

In addition, the use of a thioester compound as a color developer is proposed, as disclosed in Japanese Laid-Open Patent Application 59-165680; and phenolsulfonic acid and derivatives thereof are used as the color developers, as in Japanese Laid-Open Patent Applications 58-82788 and 60-13852. When the aforementioned compounds are used as the color developers, however, the sensitivity of the obtained thermosensitive recording materials is insufficient although image areas obtained in the recording materials are fast to fats and oils.

Furthermore, the addition of various thermofusible materials is proposed to increase the thermal sensitivity, for example, benzoate compounds in Japanese Laid-Open Patent Application 57-128592; phenylether derivatives in Japanese Laid-Open Patent Applications 58-57989, 58-87088 and 61-31287; naphthol derivatives in Japanese Laid-Open Patent Application 58-87064; and benzylbiphenyl in Japanese Laid-Open Patent Application 60-82382.

The thermosensitive recording materials comprising the above-mentioned color developers or thermofusible materials are not satisfactory from the viewpoints of the thermal coloring sensitivity, the whiteness degree of the background, and the preservability of the obtained images such as fading of the images and deposition of white dust on the recording material.

The use of a phenyl benzoate as a thermosensitivity-improving agent is proposed, as disclosed in Japanese Laid-Open Patent Applications 57-128592 and 58-59894. However, the thermosensitive recording materials comprising the phenyl benzoate as disclosed in the above applications are still insufficient in the thermal coloring sensitivity, and the preservability of the recording materials in terms of the image fading, deposition of white dust and coloring of the background.

The formation of an intermediate layer is proposed to increase the recording sensitivity without decreasing the whiteness degree of the background. For instance, there are proposed an intermediate layer mainly comprising minute void particles, as in Japanese Laid-Open Patent Applications 59-5093 and 59-225987; and an intermediate layer comprising non-expandable void particles, as in Japanese Laid-Open Patent Application 62-5886. However, these recording materials have the shortcomings that the thermal coloring sensitivity is insufficient and the recording properties are poor.

SUMMARY OF THE INVENTION

Accordingly, an object of the present invention is to provide a thermosensitive recording material with high thermal coloring sensitivity and good recording properties, capable of coping with high-speed thermal recording, with the recorded images having high reliability and excellent preservability, and the whiteness degree of the background thereof maintained high.

The above-mentioned object of the present invention can be achieved by a thermosensitive recording material comprising a support and a thermosensitive recording layer formed on the support, comprising a leuco dye, a color developer capable of inducing color formation in the leuco dye upon application of heat thereto, and a thermofusible material comprising p'-methylphenyl p-chlorobenzoate serving as a thermosensitivity-improving agent.

DESCRIPTION OF THE PREFERRED EMBODIMENTS

The thermosensitive recording material of the present invention comprises a thermosensitive recording layer which comprises p'-methylphenyl p-chlorobenzoate serving as a thermosensitivity-improving agent, so that the recording sensitivity is improved, the whiteness degree of the background is sufficiently high, the matching properties with a thermal head are good in the course of thermal recording, and the preservability of the recording material is satisfactory, free from the deposition of white dust and the sublimation property of p'-methylphenyl p-chlorobenzoate. Therefore, the thermosensitive recording material of the present invention is suitable for high speed thermal recording.

The thermosensitive recording material of the present invention may further comprise an intermediate layer comprising as the main component plastic void particles in the form of sphere, which is provided between the support and the thermosensitive recording layer. This intermediate layer serves as a heat-insulating layer. Owing to the intermediate layer, therefore, thermal energy supplied by a thermal head can efficiently be utilized, thereby improving the thermosensitivity of the recording material.

The void particles for use in the intermediate layer comprise a thermoplastic resin for forming a shell of each void particle. A copolymer resin mainly comprising vinylidene chloride and acrylonitrile is preferably used a the above-mentioned thermoplastic resin. Air or other gasses are contained in the void particles in the expanded state.

It is preferable that the particle diameter of the void particles be 2 to 10 μm in the present invention. When the particle size of the void particles is within the above range, there is no problem in the production of the intermediate layer because the voidage of the void particles can freely be determined. In addition, the surface smoothness of the intermediate layer prepared by coating a coating liquid comprising the void particles and drying the same is not decreased, so that the adhesion of the recording layer to the thermal head does not lower, and consequently, the thermosensitivity of the recording material can be prevented from deteriorating. When the above-mentioned advantages are further taken into consideration, it is preferable that the void particles classified in a narrow distribution be employed for use in the intermediate layer.

It is preferable that the voidage of the void particles for use in the present invention be 50% or more, and more preferably 90% or more, from the viewpoint of the heat insulating effect. In the present invention, the voidage of the void particles for use in the intermediate layer is expressed by the following formula:

$$\text{Voidage (\%)} = \frac{\text{(inner diameter of void particles)}}{\text{(outer diameter of void particles)}} \times 100$$

When the voidage of the void particles is within the above range, sufficient heat insulating effect of the intermediate layer can be obtained, so that the thermal energy supplied by the thermal head is prevented from escaping through the support of the thermosensitive recording material. As a result, the thermosensitivity-improving effect can be increased. In the present invention, when the intermediate layer comprises void particles with an average particle diameter of 2 to 10 μm and a voidage of 90% or more, the flexibility of the obtained recording material is so much increased that the adhesion to the thermal had is further increased, thereby improving the dot reproduction performance.

The intermediate layer for use in the present invention may further comprise an inorganic or/and organic pigment. In this case, the oil absorption of the pigment is preferably 30 ml/100 g or more, and more preferably 80 ml/100 g or more.

The above-mentioned inorganic and/or organic pigment used in the intermediate layer, which may be employed alone or in combination, can be selected from any pigments for use in the conventional thermosensitive recording materials. Specific examples of the inorganic pigment are calcium carbonate, silica, zinc oxide, titanium oxide, aluminum hydroxide, zinc hydroxide, barium sulfate, clay, talc, and surface-treated calcium and silica. Specific examples of the organic pigment are urea-formaldehyde resin, styrene-methacrylic acid copolymer and polystyrene resin.

The thermosensitive recording layer of the recording material according to the present invention comprises a leuco dye serving as a coloring agent and a color developer.

As the leuco dye for use in the present invention, which may be employed alone or in combination, any conventional dyes for use in the conventional leuco-dye-containing recording materials can be employed. For example, triphenylmethanephthalide leuco compounds, triallylmethane leuco compounds, fluoran leuco compounds, phenothiazine leuco compounds, thiofluoran leuco compounds, xanthene leuco compounds, indophthalyl leuco compounds, spiropyran leuco compounds, azaphthalide leuco compounds, couromeno-pyrazole leuco compounds, methine leuco compounds, rhodamineanilinolactam leuco compounds, rhodaminelactam leuco compounds, quinazoline leuco compounds, diazaxanthene leuco compounds and bislactone leuco compounds are preferably employed. Specific examples of those leuco dyes are as follows:

3,3-bis(p-dimethylaminophenyl)phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-cyclohexylamino-6-chlorofluoran,
3-dimethylamino-5,7-dimethylfluoran,
3--diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N,N-di-N-amylamino-6-methyl-7-anilinofluoran,
3-N-methyl-N-amylamino-6-methyl-7-anilinofluoran,
3-N-methyl-N-iso-propylamino-6-methyl-7-anilinofluoran,
3-N-methyl-N-cyclohexylamino-6-methyl-7-anilinofluoran,
3-(N-methyl-N-isoamylamino)-6-methyl-7-anilinofluoran,
3-(N-methyl-N-isobutylamino)-6-methyl-7-anilinofluoran,
3-diethylamino-6-chloro-anilinofluoran,
3-(N-ethyl-N-2-ethoxypropylamino)-6-methyl-7-anilinofluoran,
3-(N-ethyl-N-tetrahydrofurfurylamino)-6-methyl-7-anilinofluoran,
3-diethylamino-6-methyl-7-anilinofluoran,
3-dibutylamino-6-methyl-7-anilinofluoran,
3dibutylamino-6-methyl-7-anilinofluoran,
3-(N,N-diethylamino)-5-methyl-7-(N,N-dibenzylamino)fluoran,
benzoyl leuco methylene blue,
6'-chloro-8'-methoxy-benzoindolino-spiropyran,
6'-bromo-8'-methoxy-benzoindolino-spiropyran, 3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-diethylamino-6-methyl-7-(2',4'-dimethylanilino)fluoran,
3-(2'-methoxy-4'-dimethylaminophenyl)-3-(2'-hydroxy-4'-chloro-5'-methylphenyl)phthalide,
3-morphorino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)-fluoran,
3-(N-ethyl-N-cyclohexylamino)-5,6-benzo-7-α-naphtylamino-4'-bromofluoran,
3-(N-benzyl-N-cyclohexylamino)-5,6-benzo-7-α-naphthylamino-4'-bromofluoran,
3-diethylamino-6-methyl-7-mesidino-4',5'-benzofluoran,
3-(p-dimethylaminophenyl)-3-[1,1-bis(p-dimethylaminophenyl)ethylene-2-yl]phthalide,
3-(p-dimethylaminophenyl)-3-[1,1-bis(p-dimethylaminophenyl)ethylene-2-yl]-6-dimethylaminophthalide,
3-(p-dimethylaminophenyl)-3-(1-p-dimethylaminophenyl-1-phenylethylene-2-yl)phthalide,
3-(p-dimethylaminophenyl)-3-(1-p-dimethylaminophenyl-1-p-chlorophenylethylene-2-yl)-6-dimethylaminophthalide,
3-(4'-dimethylamino-2'-methoxy)-3-(1''-p-dimethylaminophenyl-1''-p-chlorophenyl-1'',3''-butadiene-4''-yl)-benzophthalide,
3-(4'-dimethylamino-2'-benzyloxy)-3-(1''-p-dimethylaminophenyl-1''-phenyl-1'',3''-butadiene-4''-yl)benzophthalide,
3,6-bis(dimethylamino)fluorenespiro(9,3')-6'-dimethylaminophthalide,
3-dimethylamino-6-dimethylamino-fluorene-9-spiro-3'-(6'-dimethylamino)phthalide,
3,3-bis-[2-[p-dimethylaminophenyl)-2-(p-methoxyphenyl)ethenyl]-4,5,6,7-tetrachlorophthalide,
3-bis[1,1-bis(4-pyrrolidinophenyl)ethylene-2-yl]-5,6-dichloro-4,7-dibromophthalide,
bis(p-dimethylaminostyryl)-1-naphthalenesulfonylmethane, and
bis[p-dimethylaminostyryl)-1-p-tolylsulfonylmethane.

As the color developer for use in the present invention, a variety of electron-acceptors, for instance, phenolic compounds, thiophenolic compounds, thiourea derivatives, organic acids and metallic salts thereof can be employed. Specific examples of the color developer are as follows:

4,4'-isopropylidenebisphenol,
3,4'-isopropylidenebisphenol,
4,4'-isopropylidenebis(o-methylphenol),
4,4'-sec-butylidenebisphenol,
4,4'-isopropylidenebis(o-tert-butylphenol),
4,4'-cyclohexylidenediphenol,
4,4'-isopropylidenebis(2-chlorophenol),
2,2'-methylenebis(4-methyl-6-tert-butylphenol),
2,2'-methylenebis(4-ethyl-6-tert-butylphenol),
4,4'-butylidenebis(6-tert-butyl-2-methyl)phenol,
1,1,3-tris(2-methyl-4-hydroxy-5-tert-butylphenyl)butane,
1,1,3-tris(2-methyl-4-hydroxy-5-cyclohexylphenyl)butane,
4,4'-thiobis(6-tert-butyl-2-methyl)phenol,
4,4'-diphenolsulfone,
4,2-diphenolsulfone,
4-isopropoxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
1,7-bis(4-hydroxyphenylthio)-3,5-dioxaheptane,
1,5-bis(4-hydroxyphenylthio)-3-oxapentane,
1,3-bis(4-hydroxyphenylthio)-propane,
2,2'-methylenebis(4-ethyl-6-tert-butylphenol),
1,3-bis[4-hydroxyphenylthio)-2-hydroxypropane,
N,N'-diphenylthiourea,
N,N'-di(m-chlorophenyl)thiourea,
salicylanilide,
5-chloro-salicylanilide,
salicyl-o-chloroanilide,
2-hydroxy-3-naphthoic acid,
antipyrine complex of zinc thiocyanate,
zinc salt of 1-acetyloxy-2-naphthoic acid,
zinc salt of 2-acetyloxy-3-naphthoic acid,
zinc salt of 2-acetyloxy-1-naphthoic acid,
2-hydroxy-1-naphthoic acid,
1-hydroxy-2-naphthoic acid,
zinc hydroxynaphthoate,
aluminum hydroxynaphthoate,
calcium hydroxynaphthoate,
bis(4-hydroxyphenyl)methyl acetate,
bis(4-hydroxyphenyl)benzyl acetate,
4-[β-(p-methoxyphenoxy)ethoxy]salicyl acid,
1,3-bis(4-hydroxycumyl)benzene,
1,4-bis(4-hydroxycumyl)benzene,
2,4'-diphenolsulfone,
3,3'-diallyl-4,4'-diphenolsulfone,
α,α-bis(4-hydroxyphenyl)-α-methyltoluene,
tetrabromobisphenol A,
tetrabromobisphenol S,
4,4'-thiobis(2-methylphenol),
4,4'-thiobis(2-chlorophenol),
zinc p-nitrobenzoate,
1,3,5-tris(4-tert-butyl-3-hydroxy-2,6-dimethylbenzyl-)isocyanuric acid,
2,2-bis(3,4'-dihydroxyphenyl)propane, and
bis(4-hydroxy-3-methylphenyl)sulfide.

To obtain a thermosensitive recording material according to the present invention, a variety of conventional binder agents can be employed in the thermo-sensitive recording layer of binding the above-mentioned leuco dyes, color developers, thermosensitivity-improving agent and auxiliary components to be described later to the support of the thermosensitive recording material. As the binder agent for use in the present invention, any conventional binder agents used in the conventional thermo-sensitive recording materials can appropriately be employed. Examples of the binder agent are water-soluble polymers such as polyvinyl alcohol, starch and starch derivatives, cellulose derivatives such as methoxycellulose, hydroxyethylcellulose, carboxymethylcellulose, methylcellulose, and ethylcellulose, sodium polyacrylate, polyvinyl pyrrolidone, acrylamide-acrylic ester copolymer, acrylamide-acrylic ester-methacrylic acid terpolymer, alkali salts of styrene-maleic anhydride copolymer, alkali salts of isobutylene-maleic anhydride copolymer, polyacrylamide, sodium alginate, gelatin, and casein; emulsions such as polyvinyl acetate, polyurethane, polyacrylic ester, polymethacrylic ester, vinyl chloride-vinyl acetate copolymer, and ethylene-vinyl acetate copolymer; and latexes such as styrene-butadiene copolymer and styrene-butadiene-acrylic copolymer.

According to the present invention, the thermosensitive recording layer comprises a thermofusible material as the thermosensitivity-improving agent, which comprises p'-methylphenyl p-chlorobenzoate. When necessary, a variety of thermofusible compounds may be used in combination with p'-methylphenyl p-chlorobenzoate.

The specific examples of the above-mentioned thermofusible compounds are as follows: fatty acids such as stearic acid, and behenic acid; fatty amides such as stearic acid amide, and palmitic acid amide; fatty acid metallic salts such as zinc stearate, aluminum stearate, calcium stearate, zinc palmitate, and zinc behenate; and p-benzylbiphenyl, terphenyl, triphenylmethane, benzyl p-benzyloxybenzoate, β-benzyloxy naphthalene, phenyl β-naphthoate, phenyl 1-hydroxy-2-naphthoate, methyl 1-hydroxy-2-naphthoate, diphenyl carbonate, guaiacol carbonate, dibenzyl terephthalate, dimethyl terephthalate, 1,4-dimethoxynaphthalene, 1,4-ethoxynaphthalene, 1,4-dibenzyloxynaphthalene, 1,2-bis(-phenoxy)ethane, 1,2-bis(3-methylphenoxy)ethane, 1,2-bis(4-methyl-phenoxy)ethane, 1,4-bis(phenoxy)butane, 1,4-bis(phenoxy)-2-butene, 1,2-bis(4-methoxyphenylthio)ethane, dibenzoylmethane, 1,4-bis(phenylthio)butane, 1,4-bis(phenylthio)-2-butene, 1,2-bis(4-methoxyphenylthio)ethane, 1,3-bis(2-vinyloxyethoxy)benzene, 1,4-bis(2-vinyloxyethoxy)benzene, p-(2-vinyloxyethoxy)-biphenyl, p-aryloxybiphenyl, p-propargylxybiphenyl, dibenzoyloxymethane, 1,3-dibenzoyloxypropane, dibenzyl disulfide, 1,1-diphenyl-ethanol, 1,1-diphenylpropanol, p-(benzyloxy)benzylalcohol, 1,3-diphenoxy-2-propanol, N-octadecylcarbamoyl-p-methoxycarbonylbenzene, N-octadecylcarbamoylbenzene, dibenzyl oxalate, bis(4-methylbenzyl)oxalate, bis(4-chlorobenzyl)oxalate, 1,5-bis{p-methoxyphenyloxy)-3-oxapentane, and 1,2-bis(4-methoxyphenoxy)propane.

When necessary, the thermosensitive recording layer for use in the present invention may further comprise auxiliary additive components such as a filler, a surface active agent, a lubricant and an agent for preventing color formation by pressure application, which are used in the conventional thermosensitive recording materials. Example of the filler for use in the present invention are finely-divided particles of inorganic fillers such as calcium carbonate, silica, zinc oxide, titanium oxide, aluminum hydroxide, zinc hydroxide, barium sulfate, clay, kaolin, talc, surface-treated calcium and surface-treated silica; and finely-divided particles of organic fillers such as urea-formaldehyde resin, styrene-methacrylic acid copolymer, polystyrene resin and vinylidene chloride resin.

Examples of the lubricant for use in the present invention include higher fatty acids and amides, esters and metallic salts thereof; and a variety of waxes such as an animal wax, a vegetable wax, a mineral wax, and a petroleum wax.

In the thermosensitive recording layer, it is preferable that the amount of the color developer be 0.5 to 10.0 parts by weight to one part by weight of the leuco dye. In addition, the sensitizer is preferably contained in the thermosensitive recording layer in a amount of 0.5 to 10.0 parts by weight, more preferably 1 to 5 parts by weight, to one part by weight of the leuco dye.

The thermosensitive recording material of the present invention may further comprise an additional layer comprising a pigment, a binder agent and a thermofusible material when necessary, which is provided between the previously mentioned intermediate layer and the thermo-sensitive recording layer.

Furthermore, the thermosensitive recording material may further comprise a protective layer which is provided on the thermosensitive recording layer in order to improve the preservation stability of the recorded images and the writing quality of the recording material. The protective layer comprises the previously mentioned pigment, binder agent, and thermofusible material.

Other features of this invention will become apparent in the course of the following description of exemplary embodiments, which are given for illustration of the invention and are not intended to be limiting thereof.

EXAMPLE 1Formation of intermediate layer

A mixture of the following components was stirred and dispersed, so that a coating liquid A for an intermediate layer was prepared:

| [Liquid A] | Parts by Weight |
|---|---|
| Dispersion of finely-divided void particles (copolymer resin comprising styrene and acryl as the main components) (solid content: 38 wt. %, average particle diameter: 0.7 μm, and voidage: 80%) | 30 |
| Styrene - butadiene copolymer latex (solid content: 47.5 wt. %) | 10 |
| Water | 60 |

The thus obtained intermediate layer coating liquid A was coated on a sheet of commercially available high quality paper with a basis weight of 52 g/m$^2$, serving as a support, and then dried so as to have a coating amount of 5 g/m$^2$ on a dry basis, whereby an intermediate layer was formed on the support.

Formation of Thermosensitive Recording Layer

A mixture of the following components was separately pulverized in a porcelain ball mill for 2 days, so that a Liquid B, a Liquid C, a Liquid D and a Liquid E were prepared:

| | Parts by Weight |
|---|---|
| [Liquid B] | |
| 3-(N-methyl-N-cyclohexyl)amino-6-methyl-7-anilinofluoran | 20 |
| 10% aqueous solution of polyvinyl | 20 |

-continued

| | Parts by Weight |
|---|---|
| alcohol | |
| Water | 60 |
| [Liquid C] | |
| 4,4'-isopropylidenediphenol | 20 |
| 10% aqueous solution of polyvinyl alcohol | 20 |
| Water | 60 |
| [Liquid D] | |
| p'-methylphenyl p-chlorobenzoate (m.p.: 99° C.) | 20 |
| 10% aqueous solution of polyvinyl alcohol | 20 |
| Water | 60 |
| [Liquid E] | |
| Calcium carbonate | 20 |
| Methyl cellulose | 20 |
| Water | 60 |

10 parts by weight of the Liquid B, 30 parts by weight of the Liquid C, 20 parts by weight of the Liquid D, 40 parts by weight of the Liquid E and 10 parts by weight of a commercially available dispersion of zinc stearate (Trademark: Hidorin Z-730", made by Chukyo Yushi Co., Ltd.) with a concentration of 30% were mixed to prepare a thermosensitive recording layer coating liquid. The thus prepared thermosensitive recording layer coating liquid was coated on the above prepared intermediate layer and dried in such a fashion that the deposition amount of the dye was 0.5 g/m$^2$ on a dry basis, whereby a thermosensitive recording layer was formed on the intermediate layer. Furthermore, the surface of the thus prepared thermosensitive recording layer was subjected to calendering so as to have a surface smoothness of 500 to 600 sec, whereby a thermosensitive recording material according to the present invention was obtained.

EXAMPLE 2

The procedure for preparation of the thermosensitive recording material in Example 1 was repeated except that the Liquid A used in formation of the intermediate layer in Example 1 was replaced by a Liquid F with the following formulation:

| [Liquid F] | Parts by Weight |
|---|---|
| Dispersion of finely-divided void particles (copolymer comprising vinylidene chloride and acrylonitrile as the main components) (solid content: 32 wt. %, average particle diameter: 5 μm, and voidage: 92%) | 30 |
| Styrene - butadiene copolymer latex (solid content: 47 wt. %) | 20 |
| Water | 60 |

Thus, a thermosensitive recording material according to the present invention was obtained.

EXAMPLE 3

The procedure for preparation of the thermosensitive recording material in Example 1 was repeated except that the Liquid C used in formation of the thermosensitive recording layer in Example 1 was replaced by a Liquid G with the following formulation:

| [Liquid G] | Parts by Weight |
|---|---|
| 4,4'-isopropylidenediphenol | 20 |
| 10% aqueous solution of polyvinyl alcohol | 20 |
| 1,1,3-tris(2-methyl-4-hydroxy-5-cyclohexylphenylbutane) | 20 |
| Water | 60 |

Thus, a thermosensitive recording material according to the present invention was obtained.

COMPARATIVE EXAMPLE 1

The procedure for preparation of the thermo-sensitive recording material in Example 1 was repeated except that the Liquid D used in formation of the thermosensitive recording layer in Example 1 was replaced by a Liquid H with the following formulation:

| [Liquid H] | Parts by Weight |
|---|---|
| p-methylphenyl benzoate (m.p.: 72° C.) | 20 |
| 10% aqueous solution of polyvinyl alcohol | 20 |
| Water | 60 |

Thus, a comparative thermosensitive recording material was obtained.

COMPARATIVE EXAMPLE 2

The procedure for preparation of the thermosensitive recording material in Example 1 was repeated except that the Liquid D used in formation of the thermosensitive recording layer in Example 1 was replaced by a Liquid I with the following formulation:

| [Liquid I] | Parts by Weight |
|---|---|
| p-chlorophenyl benzoate (m.p.: 88° C.) | 20 |
| 10% aqueous solution of polyvinyl alcohol | 20 |
| Water | 60 |

This, a comparative thermosensitive recording material was obtained.

COMPARATIVE EXAMPLE 3

The procedure for preparation of the thermosensitive recording material in Example 1 was repeated except that the Liquid D used in formation of the thermosensitive recording layer in Example 1 was replaced by a Liquid J with the following formulation:

| [Liquid J] | Parts by Weight |
|---|---|
| Phenyl p-chlorobenzoate (m.p.: 103° C.) | 20 |
| 10% aqueous solution of polyvinyl alcohol | 20 |
| Water | 60 |

Thus, a comparative thermosensitive recording material was obtained.

COMPARATIVE EXAMPLE 4

The procedure for preparation of the thermosensitive recording material in Example 1 was repeated except that the Liquid D used in formation of the thermosensitive recording layer in Example 1 was replaced by a Liquid K with the following formulation:

| [Liquid K] | Parts by Weight |
|---|---|
| 2,4-dichlorophenyl benzoate (m.p.: 92° C.) | 20 |
| 10% aqueous solution of polyvinyl alcohol | 20 |
| Water | 60 |

Thus, a comparative thermosensitive recording material was obtained.

COMPARATIVE EXAMPLE 5

The procedure for preparation of the thermosensitive recording material in Example 1 was repeated except that the Liquid D used in formation of the thermosensitive recording layer in Example 1 was replaced by a Liquid L with the following formulation:

| [Liquid L] | Parts by Weight |
|---|---|
| p-methylbenzyl oxalate (m.p.: 106° C.) | 20 |
| 10% aqueous solution of polyvinyl alcohol | 20 |
| Water | 60 |

Thus, a comparative thermosensitive recording material was obtained.

Using a commercial available test apparatus for evaluating the thermal coloring performance of thermo-sensitive sheets, images were recorded on each of the thermosensitive recording material obtained in Example 1 to 3 and Comparative Examples 1 to 5 under the conditions that the applied electric power was 0.45 W/dot and the period for one lien was 8 ms/line, with the pulse width changes to 0.2 msec, 0.3 msce and 0.4 msce. The coloring density of the recorded image was measured by Mcbeth densitometer RD-914. The results are given in Table 1.

TABLE 1

| | Coloring Density | | | Density | Deposition of White | Head-matching |
|---|---|---|---|---|---|---|
| | 0.2 ms | 0.3 ms | 0.4 ms | of Back-ground | Dust on Images | Properties (*) |
| Ex. 1 | 0.35 | 0.70 | 1.22 | 0.07 | Nil | o |
| Ex. 2 | 0.40 | 0.85 | 1.30 | 0.07 | Nil | o |
| Ex. 3 | 0.35 | 0.82 | 1.25 | 0.07 | Nil | o |
| Comp. Ex. 1 | 0.40 | 0.80 | 1.24 | 0.07 | Nil | o |
| Comp. Ex. 2 | 0.35 | 0.69 | 1.20 | 0.07 | Nil | o |
| Comp. Ex. 3 | 0.36 | 0.73 | 1.22 | 0.07 | Nil | o |
| Comp. Ex. 4 | 0.33 | 0.68 | 1.20 | 0.07 | Observed | o |
| Comp. Ex. 5 | 0.33 | 0.60 | 1.17 | 0.07 | Nil | x |

[Note]
(*): Head-matching properties
o: Dust formed from the thermosensitive recording material did not adhere to the thermal head.
x: Dust formed from the thermosensitive recording material adhered to the thermal head.

In particular, with respect to the thermosensitive recording materials obtained in Examples 2 and 3, the dot reproduction performance of the recorded images was excellent.

Furthermore, thermal recording was carried out on each thermosensitive recording material using a heated block of 130° C. under the application of a pressure of 2 kg/cm$^2$ thereto. Each image sample obtained by the above-mentioned thermal recording was subjected to the following tests: (1) Heat-resistance test (a): After the image sample was allowed to stand at 60° C. in a dry condition for 16 hours, the coloring density of the image was measured. (2) Heat-resistance test (b): After the image sample was allowed to stand at 70° C. in a dry condition for one hour, the coloring density of the image was measured. (3) Water-resistance test: After the image sample was immersed in tap water at room temperature for 16 hours, the coloring density of the image was measured. (4) Sublimation property test: After the image sample was allowed to stand at 60° C. in a dry condition for 16 hours, the coloring thermosensitivity of the recording material was again examined, which was affected by the sublimation property of p'-methylphenyl p-chlorobenzoate.

The results are shown in Table 2.

TABLE 2

| | Density Before Tests | | After Heat-resistance Test (a) | | After Heat-resistance Test (b) | | After Water-resistance Test | | |
|---|---|---|---|---|---|---|---|---|---|
| | Coloring Density | Density of Back-ground | Coloring Density | Density of Back-ground | Coloring Density | Density of Back-ground | Coloring Density | Density of Back-ground | Sublimation Property |
| Ex. 1 | 1.36 | 0.07 | 1.38 | 0.10 | 1.37 | 0.13 | 1.02 | 0.07 | Nil |
| Ex. 2 | 1.35 | 0.07 | 1.38 | 0.10 | 1.37 | 0.13 | 1.00 | 0.07 | Nil |
| Ex. 3 | 1.36 | 0.07 | 1.37 | 0.10 | 1.37 | 0.13 | 1.10 | 0.07 | Nil |
| Comp. Ex. 1 | 1.35 | 0.07 | 1.35 | 0.18 | 1.35 | 0.32 | 0.79 | 0.07 | Observed |
| Comp. Ex. 2 | 1.35 | 0.07 | 1.36 | 0.14 | 1.35 | 0.29 | 0.82 | 0.07 | Observed |
| Comp. Ex. 3 | 1.34 | 0.07 | 1.37 | 0.12 | 1.36 | 0.15 | 0.69 | 0.07 | Observed |
| Comp. Ex. 4 | 1.35 | 0.07 | 1.38 | 0.12 | 1.35 | 0.18 | 0.52 | 0.07 | Nil |
| Comp. Ex. 5 | 1.35 | 0.07 | 1.38 | 0.10 | 1.34 | 0.13 | 0.93 | 0.07 | Nil |

As can be seen from the results shown in Table 1 and 2, the thermal coloring sensitivity and the coloring density of the obtained images are excellent in the thermosensitive recording materials according to the present invention. In addition, the head-matching properties are improved and the images recorded on the thermosensitive recording materials of the present invention are resistant to heat and water, so that the preservation stability of recorded images is excellent. Therefore, the thermosensitive recording materials of the present invention are regarded as very useful in the practical use.

As previously explained, since the thermosensitive recording layer of the thermosensitive recording material of the present invention comprises p'-methylphenyl p-chlorobenzoate as a thermosensitivity-improving agent, the coloring sensitivity is remarkably improved, with the whiteness degree of the background maintained high. In addition, the heat-resistance and water-resistance of the recorded images are excellent, and neither the deposition of white dust on the recorded images is observed, nor the sublimation property of p'-methylphenyl p-chlorobenzoate is detected. Furthermore, the head-matching properties of the recording material are excellent.

When the intermediate layer comprising the plastic void particles is interposed between the support and the thermosensitive recording layer in the present invention, the thermal energy supplied by the thermal head can efficiently be utilized, so that the thermosensitivity is further improved, and at the same time, the head-matching properties are further improved.

What is claimed is:

1. A thermosensitive recording material comprising a support and thermosensitive recording layer formed on said support, comprising a leuco dye, a color developer capable of inducing color formation in said leuco dye upon application of hat therto, and a thermofusible material comprising p'-methylphenyl p-chlorobenzoate serving as a thermosensitivity-improving agent.

2. The thermosensitive recording material as claimed in claim 1, further comprising an intermediate layer which is provided between said support and said thermosensitive recording layer.

3. The thermosensitive recording material as claimed in claim 2, wherein said intermediate layer comprises plastic void particles.

4. The thermosensitive recording material as claimed in claim 3, wherein said void particles for use in said intermediate layer have an average particle diameter of 2 to 10 μm.

5. The thermosensitive recording material as claimed in claim 3, wherein said void particles for use in said intermediate layer have a voidage of 50% or more.

* * * * *

UNITED STATES PATENT AND TRADEMARK OFFICE

CERTIFICATE OF CORRECTION

PATENT NO. : 5,306,687

DATED : APRIL 26, 1994

INVENTOR(S) : FURUYA ET AL

It is certified that error appears in the above-indentified patent and that said Letters Patent is hereby corrected as shown below:

On column 3, line 12 "...used a the..." should read --...used as the...--.

On column 4, line 63 "3dibutylamino-6-methyl-7-anilinofluoran" should read --3-dibutylamino-6-methyl-7-anilinofluoran--.

On column 6, line 9 "...butylphenyl)butane," should read —...butylphenyl)-butane,—.

On column 6 line 11 "...cyclohexylphenyl)butane," should read --...cyclohexylphenyl)-butane,--.

On column 11, line 34 and 35 "...Example 1 to 3..." should read --...Examples 1 to 3...--.

On column 14, line 8 "...of hat therto,..." should read --...of heat thereto,...--.

Signed and Sealed this

Twenty-third Day of May, 1995

Bruce Lehman

*Attest:*

BRUCE LEHMAN

*Attesting Officer*

*Commissioner of Patents and Trademarks*